United States Patent [19]

Stuart

[11] 3,985,602

[45] Oct. 12, 1976

[54] TRANSFER PROCESS AND COMPOSITE SHEET THEREFOR

[75] Inventor: James H. Stuart, Pueblo, Colo.

[73] Assignee: Sangray Corporation, Pueblo, Colo.

[22] Filed: Oct. 11, 1974

[21] Appl. No.: 513,993

[52] U.S. Cl. ..... 156/235; 156/240; 156/249; 428/29; 428/202

[51] Int. Cl.[2] ..... B44C 1/16

[58] Field of Search ..... 156/230, 235, 240, 249, 156/306, 277; 117/3.4, 76 A; 161/406; 428/29, 40, 67, 202, 204

[56] References Cited

UNITED STATES PATENTS

| | | | |
|---|---|---|---|
| 2,191,704 | 2/1940 | Bennett | 117/3.1 |
| 3,235,395 | 2/1966 | Scharf | 117/3.4 X |
| 3,350,254 | 10/1967 | Morgan et al. | 156/235 |
| 3,359,127 | 12/1967 | Meyer et al. | 117/3.4 |
| 3,589,966 | 6/1971 | Gardner | 156/277 |
| 3,607,526 | 9/1971 | Biegen | 156/235 |
| 3,770,479 | 11/1973 | Dunning | 117/3.4 |
| 3,843,480 | 10/1974 | Dreher | 156/306 X |

*Primary Examiner*—William A. Powell
*Assistant Examiner*—John E. Kittle
*Attorney, Agent, or Firm*—Frank C. Lowe

[57] ABSTRACT

A composite transfer sheet for lifting a printed image from a paper backing and thereafter transferring the same to a substrate of cloth or like material by the application of heat. An important feature of the composite sheet resides in the use of a protective layer of a selected, transparent, thermoplastic material which carries an adhesive to retain the image. Upon the application of heat, this thermoplastic layer will melt into and bond with the substrate. At the same time, this image is securely fixed upon the substrate beneath the surface of the plastic layer in a manner which prevents this image from being easily washed or otherwise removed from the substrate.

7 Claims, 10 Drawing Figures

TRANSFER PROCESS AND COMPOSITE SHEET THEREFOR

The present invention relates to processes for the transfer of printed images and indicia from an original surface to another surface or backing, and to transfer sheets adapted to be utilized in such a process. More particularly, these processes involve printed images and indicia which are transferred from an original paper sheet to a backing surface, a substrate, by a composite sheet having a carrier layer which holds the printed images and indicia when the images and indicia are removed from the original sheet. As such, the present invention is an improvement on the transfer process of the prior U.S. Pat. No. 3,607,526.

The present invention was conceived and developed with the consideration in view of providing covering, and especially a water and soap resistant covering for the image transferred. Such covering is of particular value when a cloth substrate to which the image is transferred is an article of clothing which must be washed at intervals. Thus, the protective layer for the image should be capable of resisting the chemical action of soap, detergents and the like which are used for washing clothes. In addition, the protective layer must be transparent, so that the image shines forth in all its glory at all times. Finally, the protective layer should provide an effective bond with the substrate.

The above requirements may be secured by the use of a thermoplastic layer which preferably forms part of the composite transfer sheet and which, after the print or image is picked up, may be caused to fuse with the cloth or other substrate, thereby providing a better bond to the substrate, as well as providing a protective coating for the printing or image.

The accomplishment of the foregoing objects, as well as others, will become apparent from the description which follows, taken in conjunction with the accompanying drawings, in which.

Figure 1:
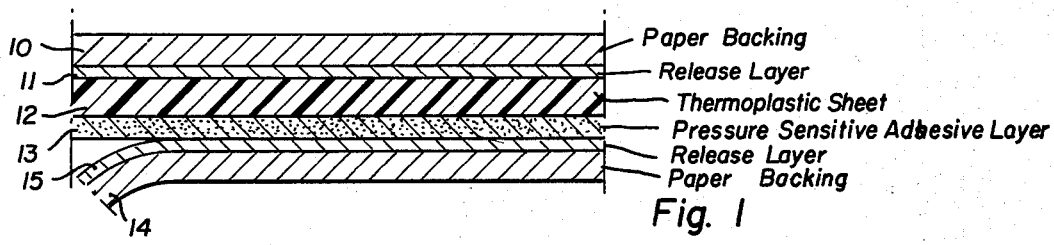
FIG. 1 is a diagrammatic section on an exaggerated scale, illustrating a composite transfer sheet which may be utilized in carrying out the process of this invention.

As illustrated in FIG. 1, the composite transfer sheet adapted to be utilized in carrying out the process of this invention comprises a paper backing 10 having a release layer 11 and superimposed on a thermoplastic sheet 12. A thermoplastic sheet 12 carries a pressure sensitive adhesive layer 13 which is initially protected by a paper cover 14 having a release layer 15. The paper cover 14 merely protects the adhesive layer 13 until the transfer sheet is to be used. For use of the transfer sheet, the paper cover 14 is separated from the pressure sensitive adhesive 13 merely by peeling off the paper cover 14.

Figure 2:
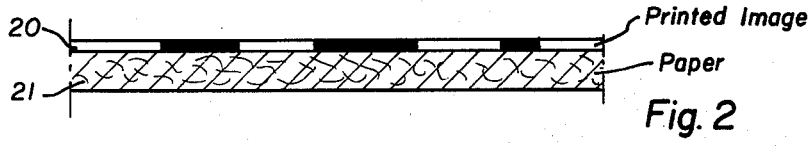
FIG. 2 is a diagrammatic section of a portion of a piece of paper or the like which carries a printed image.
Figure 3:
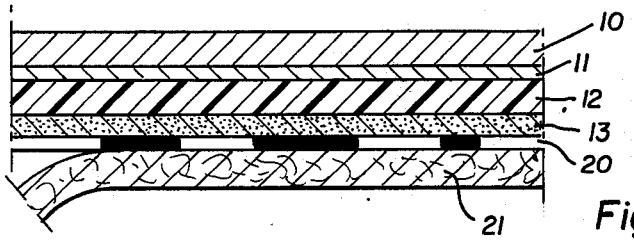
FIG. 3 is a similar diagrammatic section showing the result of bringing the composite transfer sheet of FIG. 1 and the image carrying paper of FIG. 2 together, so that the printed image adheres to the transfer sheet through a pressure sensitive adhesive layer thereof, as well as the beginning of separation of the paper which previously bore the printed image, such as after soaking in water.

In FIG. 2 is shown a printed image 20 which is printed or otherwise attached to a paper 21. In order to transfer the printed image to a pressure sensitive adhesive layer 13, the pressure sensitive layer, exposed when the paper backing 14 is removed, is merely placed against the printed image 20 to cause the printed image to be picked up by the pressure sensitive adhesive. Then, as in FIG. 3, the paper backing 21 may be removed, as by soaking the paper backing in water, or other suitable solution, to cause the paper backing to separate from the printed image, and when the paper backing 21 has been peeled off, as indicated in FIG. 3, the printed image will remain held by the pressure sensitive adhesive 13.

Figure 4:
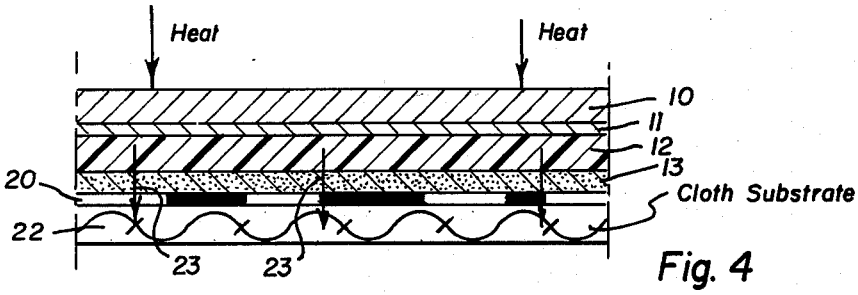
FIG. 4 is a similar diagrammatic section showing the imposition of the composite transfer sheet illustrated in FIG. 3 on a cloth or other substrate, together with the application of heat to cause the thermoplastic layer of the transfer device to fuse onto the cloth or other substrate.

In order to transfer the printed image 20 onto a cloth or other substrate 22, the composite transfer sheet, with the pressure sensitive layer 13 carrying the printed image 20, may be placed against the substrate 22. Then heat is applied, as with an iron, as indicated in FIG. 4, so that the thermoplastic sheet 12 will partially melt and fuse and blend into the pressure sensitive layer 13 and this thermoplastic sheet and pressure sensitive layer blend will then fuse and flow to or into the substrate 22 and carry the printed image 20 with it, as indicated by arrows 23 at FIG. 4. Preferably, a light pressure will be applied with application of heat to facilitate flowing the thermoplastic sheet against and into the substrate.

The paper backing 10 which carries the thermoplastic sheet 12 serves as a protective cover when this heat is applied, for example as with an iron, so that the thermoplastic sheet will melt and flow into the substrate 22 as described without being disturbed at is outward surface.

Figure 5:
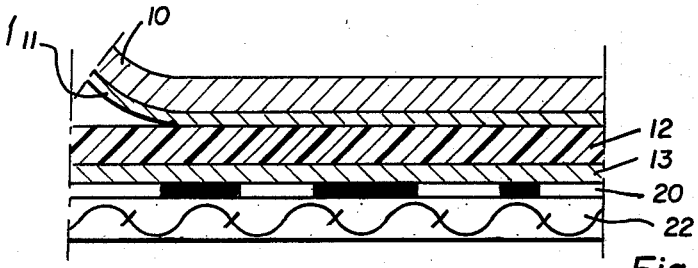
FIG. 5 is a similar diagrammatic section showing the beginning of the removal of a backing strip, as of paper, which forms a portion of the composite transfer sheet of FIG. 1, in order to expose the surface of the thermoplastic layer referred to in connection with FIG. 4.

After the thermoplastic sheet 12 has been fused to the substrate 22, the initial paper backing 10 has served its purpose and it may then be separated from the thermoplastic sheet 12 by pulling the same therefrom, as indicated in FIG. 5.

The result will be a thermoplastic surface provided by sheet 12 which will protect the printed image 20, and particularly against washing or other treatment. As will be evident, the simple operation, as by the application of heat by an iron, automatically provides a protective layer for the printed image without requiring the addition of any other protective layers which may be applied as by spraying with lacquer or the like. Also, this application of heat causes the thermoplastic sheet 12, carrying the adhesive layer and the printed image, to bond to the substrate without the necessity of treating the substrate as with a solvent, or alternately treating the thermoplastic layer as with a coating of adhesive in order to make tacky the surface of the substrate 22 and the pressure sensitive layer 23, which has been rendered relatively non-tacky by soaking to remove the paper 21. In addition, a stronger bond can be obtained with the substrate by the fusion of thermoplastic to the substrate.

The paper backing 10, release layer 11, pressure sensitive adhesive layer 13, paper backing 14 and release layer 15 may be formed of materials indicated as suitable for corresponding parts of the transfer device of the U.S. Pat. No. 3,607,526. Also, the release layers 11 and 15 may be a silicone resin. On the other hand, the thermoplastic sheet 12 is formed of a plastic which may be melted at a reasonably low temperature, such as 200° F. A polyurethane having such a melting point is a preferable material and may be from 1 mil to 10 mils thick, a thickness of 1½ mils being preferred. Other plastic sheets having a similar melting point and being sufficiently flexible to stand the rigors of hard useage, as on an article of clothing as well as being water and weather resistant, may be utilized.

Figure 6:
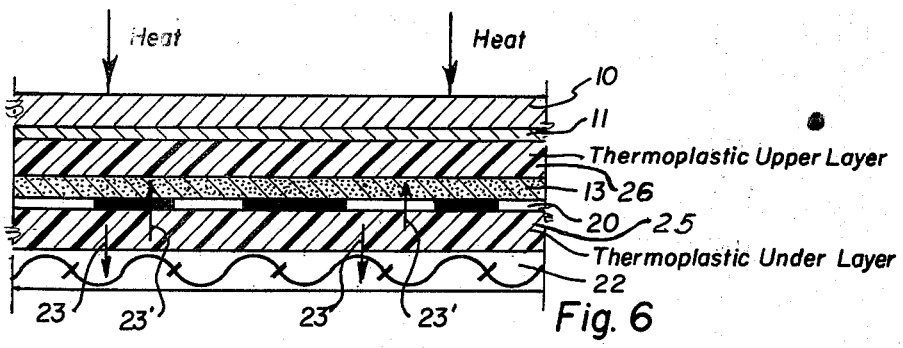
FIG. 6 is a similar diagrammatic section illustrating a modification of the operation illustrated in FIG. 4 when an additional thermoplastic layer is positioned between the printed image and the cloth or other substrate.
Figure 7:
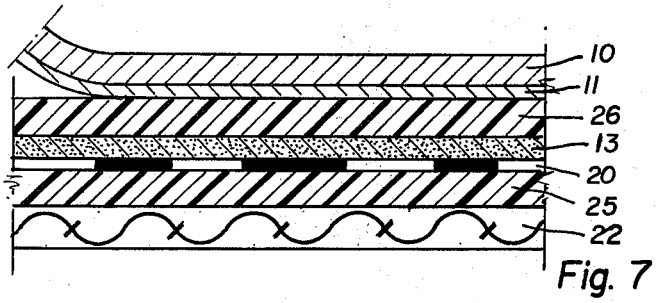
FIG. 7 is a similar diagrammatic section showing the beginning of removal of the paper backing from what was previously the transfer device.

The transfer device of FIG. 6, an alternate embodiment of the invention above described, is shown after the printed image has been picked up by the pressure sensitive layer, the paper on which the printed image appears has been removed and the transfer sheet has been placed against the substrate 22. The modification resides in the fact that a thermoplastic underlayer 25 has been interposed between the substrate 22 and printed image 20 on the transfer sheet. This thermoplastic underlayer 25 may be polyurethane of from 1 mil to 10 mils in thickness and have a reasonably low melting temperature, the same as described above.

It was found that this thermoplastic underlayer 25 could be merely placed against the printed image surface 20 of the composite transfer sheet heretofore described to provide the alternate construction, and that it would remain in place. Instead of using the composite transfer sheet heretofore described, however, a modified composite transfer sheet was preferred, which did not use the thermoplastic sheet 12 having a low melting point, but instead used a clear plastic upperlayer 26 which carries the pressure sensitive adhesive 13 which picks up the printed image. The clear plastic upper layer 26 is conveniently of polyurethane but it will have a higher melting point, such as 400° F. As will be evident, when heat is applied as indicated in FIG. 6, the clear plastic upper layer 26 will not melt and instead, the thermoplastic under layer 25 will fuse with or to the substrate 22 and also fuse with the pressure sensitive adhesive 13 and to the clear plastic upper layer 26 which is heated during melting of the thermoplastic layer 25, but not to its melting point. Arrows 23 and 23' indicate these actions. From the foregoing description of the manner in which the modified composite transfer sheet will be fitted to a substrate, it is apparent that the clear plastic upper layer 26 may be of either a thermoplastic or a thermosetting type of synthetic resin.

As will be evident, the paper backing layer 10 and release layer 11 may then be removed to expose the printed image 20. The image will be protected by the plastic layer 26 and actually be embedded into a plastic composite of the layers of plastic 26, adhesive 13 and plastic 25, and it will be difficult to remove from the substrate, or to distort or disfigure, even when the substrate is washed with detergents or the like.

Figure 8:
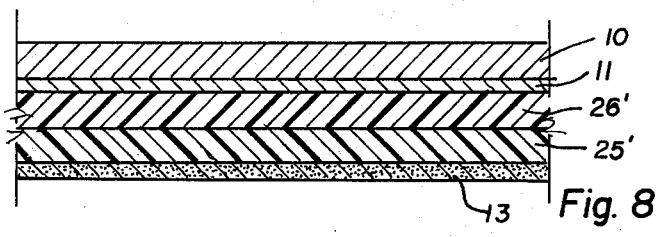
FIG. 8 is a similar diagrammatic section showing a modified transfer sheet constructed in accordance with this invention.

In the alternative embodiment illustrated in FIG. 8, the composite transfer sheet is shown after removal of the paper backing 14. This transfer sheet is provided with a laminate of two clear plastic layers 25' and 26', the former having a lower melting point, such as about 200° F., and the latter, the upper layer, a higher melting point, such as about 400° F. However, it is to be noted that the latter, the upper layer, may be of a thermosetting type of plastic which would not even melt. The layer 25' carries the pressure sensitive adhesive layer 13 which picks up the printed image 14, the same as heretofore described. Thus, after the pressure sensitive adhesive layer 13 has picked up the image 20 and the paper which carries the printed image has been removed, as through soaking in water or other solution, the transfer sheet is placed against the substrate 28 which, in this embodiment, is shown as being glass, although it can be wood or other material having a solid surface, or may be woven or porous, the same as heretofore described.

Figure 9:
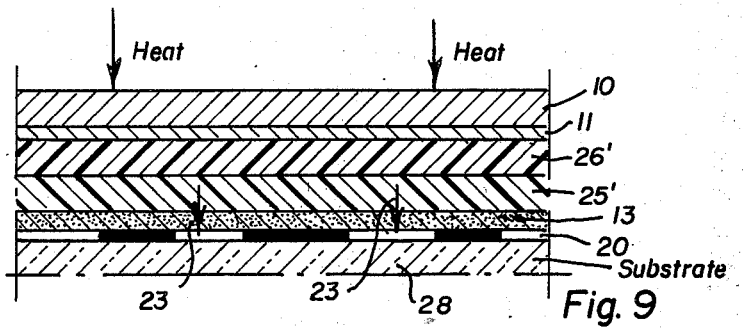
FIG. 9 is a diagrammatic section to indicate the application of heat to the transfer sheet of FIG. 8, after the printed image has been picked up and the device superimposed on a substrate.

As illustrated in FIG. 9, when heat is applied to the top paper backing 10, the thermoplastic layer 26 will be heated but will not melt, while the layer 25 will fuse through the pressure sensitive adhesive 13 and the image 20, as indicated by the arrows 23, to the substrate 28. After the layers 10 and 11 have been separated, as in FIG. 10, the protective surface for the printed image will be the higher melting point thermoplastic layer 26 to which the thermoplastic layer 25 is fused. Thus, as will be evident, the dual thermoplastic layer construction, in which thermoplastic layers of different melting points are utilized, provide the greatest protection to the printed image, as well as greater adherence to the substrate.

Figure 10:
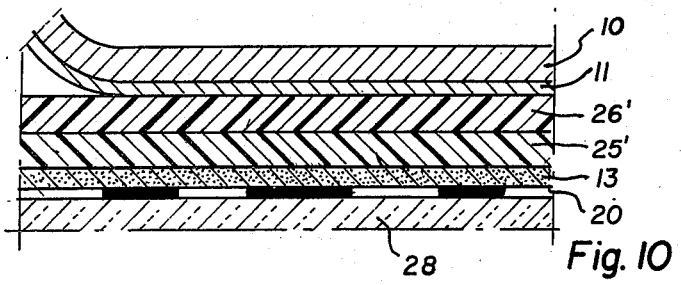
FIG. 10 is a diagrammatic section similar to FIG. 9 showing the beginning of the removal of a paper backing from the completed product of FIG. 9.

It will be understood, of course, that a glass, wood or other solid body may be substituted for the substrate 22 of FIGS. 1 – 7, while a woven or porous substrate may be substituted for the substrate 28 of FIGS. 9 and 10.

The mode of transfer of a printed image 20 from a paper backing to a substrate may be varied in minor detail from the procedure heretofore described. For example, when the transfer sheet is pressed against the printed image 20 as shown at FIG. 3, the paper backing 10 and release layer 11 may be removed first leaving the thermoplastic sheet 12 and its adhesive layer adhered to the printed image 20 and the paper backing 21. Subsequently, the paper backing may be removed, as by soaking in water, to leave the thermoplastic sheet 12, the adhesive layer 13 and the printed image 20. Thereafter, this sheet carrying the printed image may be affixed to a substrate by the application of heat to melt or soften the thermoplastic sheet so that it will bind to the new substrate. In doing so, a cover sheet which will not adhere to the thermoplastic sheet must be used for the purpose, or where the heat is applied with an iron-on operation, the iron must be of a non-stick type such as a teflon coated surface.

I have now described my invention in considerable detail. However, it is obvious that other skilled in the art can arrange and devise alternate and equivalent constructions and operations which are nevertheless within the spirit and scope of my invention. Hence, I desire that my protection be limited not by the constructions and operations illustrated and described, but only by the proper scope of the appended claims.

What is claimed is:

1. A process of using a transfer sheet for the transfer of an indicia or image to substrate, which includes:

a. forming a composite transfer sheet which includes a first plastic sheet and a second plastic sheet having a lower melting point then said first plastic sheet and providing a film of tacky contact adhesive on the exposed side of the second plastic sheet and a releasable paper backing at the opposite side of said first plastic sheet;

b. placing said tacky contact adhesive surface of the transfer sheet against the printed indicia or image provided on a sheet of paper and the like;

c. treating said combined transfer sheet and image-provided-sheet in a manner to separate said image-provided-sheet from the indicia;

d. placing said indicia or image carrying surface of the transfer sheet against the surface of a substrate;

e. applying heat through said paper backing and said first plastic sheet to cause said second plastic sheet to fuse with said tacky contact adhesive, with said indicia or image and to said substrate; and f. separating said paper backing from said first plastic sheet, so that the outer surface of said first plastic sheet will provide a protective layer for said indicia or image bonded to said substrate.

2. In a process as defined in claim 1, wherein:

said substrate is woven or porous.

3. A process as defined in claim 1, wherein:

said second plastic sheet is formed of a thermoplastic resin.

4. A process as defined in claim 3, wherein:

said first plastic sheet is formed of a thermosetting resin.

5. In a process using a transfer sheet for the transfer of an indicia or image to a substrate, wherein the transfer sheet includes a first thermoplastic sheet and a film of tacky contact adhesive at one side of the thermoplastic sheet, which includes:

a. placing said tacky contact adhesive surface of the transfer sheet againt the printed indicia or image provided on a sheet of paper and the like;

b. treating said combined transfer sheet and image-provided-sheet in a manner to separate said image-provided-sheet from the indicia;

c. placing a second thermoplastic sheet against said indicia, said second thermoplastic sheet having a lower fusion temperature than said first thermoplastic sheet;

d. placing said second thermoplastic sheet against the surface of a substrate; and e. applying heat to cause said second thermoplastic sheet to fuse with said tacky contact adhesive, with said indicia or image, to said first thermoplastic sheet and to said substrate, without fusing said first thermoplastic sheet.

6. In a process using a transfer sheet for the transfer of an indicia or image to a substrate wherein the transfer sheet includes a clear plastic sheet and a film of tacky contact adhesive at one side of the clear plastic sheet, and a releasable backing sheet at the opposite side of said plastic sheet which includes:

a. placing said tacky contact adhesive surface of the transfer sheet against the printed indicia or image provided on a sheet of paper and the like;

b. treating said combined transfer sheet and image-provided-sheet in a manner to separate said image-provided-sheet from the indicia;

c. placing a meltable thermoplastic sheet against the indicia or image carrying surface of the transfer sheet, said meltable thermoplastic sheet having a lower fusion temperature than said clear plastic sheet;

d. placing the transfer sheet and meltable thermoplastic sheet against the surface of a substrate with the meltable thermoplastic sheet at the surface of the substrate;

e. applying heat through said backing sheet to cause said meltable thermoplastic sheet to fuse with said tacky contact adhesive, said indicia or image, with said clear plastic sheet and to said substrate, without fusing said clear plastic sheet; and f. separating said backing sheet from said clear plastic sheet so that the outer surface of said clear plastic sheet will provide a protective layer for said indicia or image bonded to said substrate.

7. In the process defined in claim 6, wherein:

said clear plastic sheet is formed of a thermosetting type resin.

* * * * *